US005169371A

United States Patent [19]

Holmes

[11] Patent Number: 5,169,371

[45] Date of Patent: Dec. 8, 1992

[54] EXERCISE HANDWEIGHT FOR GUITAR PLAYERS AND OTHER MUSICIANS

[76] Inventor: R. Paul Holmes, 736 Ballough Rd., Daytona Beach, Fla. 32014

[21] Appl. No.: 733,012

[22] Filed: Jul. 19, 1991

Related U.S. Application Data

[63] Continuation of Ser. No. 398,403, Aug. 25, 1989, abandoned.

[51] Int. Cl.[5] ..... A63B 21/12

[52] U.S. Cl. ..... 482/105; 482/93

[58] Field of Search ..... 273/54 B; 272/119, 117; 482/105, 93

[56] References Cited

U.S. PATENT DOCUMENTS

| | | | |
|---|---|---|---|
| 1,729,209 | 9/1929 | Curtice | 272/119 |
| 3,490,768 | 10/1968 | Archer | 272/119 |
| 3,496,573 | 2/1970 | Kuchar | 273/54 B |
| 3,588,105 | 6/1971 | Donohoe | 272/119 |
| 4,556,215 | 12/1985 | Tarbox et al. | 272/119 |

OTHER PUBLICATIONS

Elmers original weight-you-wear, 1985, Aerobic Hand Weight.

*Primary Examiner*—Richard J. Apley
*Assistant Examiner*—J. Donnelly
*Attorney, Agent, or Firm*—Edward M. Livingston

[57] ABSTRACT

An excerise handweight for increasing strength and endurance of muscles used in playing guitars and other musical instruments including a two-layer garment having a weighted pouch on the backhand side thereof and a centrally located hole for inserting the thumb. This device is wrapped around the hand and fastened by hook and loop material or straps with buckles to securely but comfortably fit it around the musician's hand. The unique design of this device enables it to be used while the musician is playing the instrument since it does not interfere with the thumb and fingers when worn.

6 Claims, 1 Drawing Sheet

EXERCISE HANDWEIGHT FOR GUITAR PLAYERS AND OTHER MUSICIANS

This application is a continuation of Ser. No. 07/398,403 filed Aug. 25, 1989, now abandoned.

BACKGROUND OF THE INVENTION

This invention relates to exercise handweights and more particularly to an exercise handweight used to strengthen the muscles and endurance for playing guitars and other string musical instruments.

The playing of a guitar and other musical instruments requires considerable strength and endurance in the lower arm, wrist and hands. The muscles of the lower arm, wrist and, more particularly, the hand, must be sufficiently strong to endure long hours of playing. Heretofore the only way to increase the strength and endurance of these muscles was through many hours of playing a guitar. Thus, the need exists for an apparatus like the present invention that will enable a musician to increase the strength and endurance of specific muscles more rapidly than through normal usage.

Exercise handweights and gloves have been developed for sports and other uses but none like the present invention. For instance, U.S. Pat. Nos. 4,556,215 and 5,575,075 by Tarbox, et al. teach hand exercise weights which wrap around the hand and have weight in both the palm side and backhand side of the gloves. The location of the weights and design of the exercise handweights in Tarbox, however, make it impossible to utilize while playing a guitar or other musical instrument. U.S. Pat. No. 4,684,123 by Fabray shows a complete glove with a weight attached thereto. Unfortunately, the Fabray glove covers the fingers and thus would not be usable for playing a guitar. U.S. Pat. No. 4,546,495 by Castillo shows a weighted glove, but this glove too is designed with a weight to be placed in both the palm and the backhand sides, and thus would interfere with guitar playing. Another U.S. Pat. No. 4,034,979 by Wester shows a weighted bowling glove which has a weight on the backhand-side which is worn to counterbalance the pull of the bowling ball held in the other hand. This, too, is a much different design than the present invention. U.S. Pat. No. 3,369,258 by Smith shows a wraparound golf glove with thumbhole which uses Velcro fasteners. Smith's device has weight or padding contained in the palm to absorb the shock of the club. Such a weight in the palm would interfere with the flexing of the fingers and hand, thus not be usable while guitar playing.

All the above mentioned patents were developed for sports and not for increasing the strength and endurance of muscles for playing musical instruments. The only patent found dealing with strengthening the muscles for playing musical instruments is U.S. Pat. No. 535,220 by Osterhout which shows a device to increase finger strength by inserting the finger into a slot and flexing same. Unfortunately, this device could not be used while playing the instrument and did nothing to increase the strength of hand and wrist muscles.

The present invention is specially designed to increase the strength and endurance of hand and wrist muscles which are important to playing guitar or other musical instruments. By allowing the musician to wear these while playing the instrument, the musician can be more proficient at his or her instrument while increasing the strength of the pertinent muscles at the same time. Although the present invention is described in more detail later, briefly, when opened the device is somewhat elongated in shape and contains a weight sewn inside a heavy cloth material at one end, a hole centrally located along the length and width of the device for inserting the thumb and a strap at the other end so that the device can be wrapped securely and comfortably around the playing hand. In this manner the fingers and thumb are free and the weight is on the back of the hand, not the palm, so that the device does not interfere with the hand or fingers while playing.

SUMMARY OF THE INVENTION

The primary object of the instant invention is to provide a device for increasing strength and endurance in the muscles of the hand, wrist and lower arm for guitar players and other musicians.

Another object of the present invention is to provide such a device which can be used by a musician while playing the guitar or other musical instrument at the same time.

An ancillary object is to provide such a device which does not interfere with the musician's playing of the instrument.

An even further object of the instant invention is to provide such a device which is comfortable to wear.

The present invention accomplishes the above and other objects by providing an elongated garment which is shaped to wrap around either the left or right hand and has two layers or sides of material sewn at the periphery. At one end of the garment between the two layers is a weighted pouch which rests against the backhand when the device is worn. A centrally located hole for insertion of the thumb allows the garment to be worn and not move back and forth when it is being used. Fastening means at each end of the garment allow it to be secured around the hand. The fastening means may take the form of straps with interlocking hoop and loop material, such as Velcro fastening material, or straps with buckles. In order to make the present invention flexible and comfortable to wear the material within the pouch is preferably dense material such as graphite rather than a solid weight piece typical of other exercise handweight devices.

Other objects, advantages and features of the invention will become readily apparent from the following detailed description of the specific embodiments thereof when read in conjunction with the accompanying drawings.

BRIEF DESCRIPTION OF THE DRAWINGS

The drawings used to illustrate and describe the preferred embodiment which are appended to this application are as follows.

DETAILED DESCRIPTION OF THE PREFERRED EMBODIMENT

Figure 1:
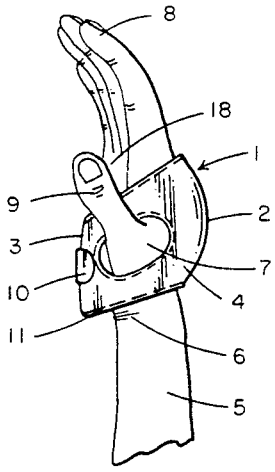
FIG. 1 is a perspective view of the present invention while worn on the hand.

Referring in detail to the drawings, FIG. 1 shows the invention 1 as worn on the hand 18 of a musician. When worn, the thumb 9 would extend through a thumbhole 7 in the device and the fingers 8 would freely stick from the top of the device so that the musician could play the guitar or other instrument without interference. The device 1 has a weighted pouch 4 on the backhand side 2 thereof. A strap 10 securely keeps the device 1 on the hand. The inner or palm side 3 contains no weight so that the musician's hand remains flexible. As shown, the entire device 1 is secured around its outer periphery by a border 11 which may be press-sealed or sewn. Thus, as shown in FIG. 1 the invention 1 can securely and comfortably fit the user's hand 18 and keep the fingers 8, thumb 9, wrist 6 and lower arm 5 free to move while playing a guitar, almost as if the device were not even worn.

Figure 2:
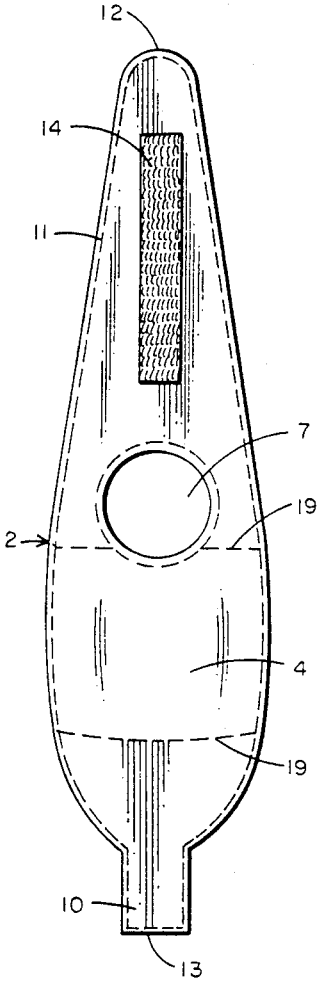
FIG. 2 is a direct view of the outer side of the invention in the open position.

In FIG. 2 the device is shown in the open position on the backhand side 2. At the top end 12 of the present invention, the device is preferably narrower for convenience in wrapping same around the user's hand 18. The fastening means, which may consist of a strip of hook and loop material such as Velcro, is shown as 14. This fastening material 14 is placed so that it securely and adjustable attaches to matching material on the inner side 3 thereof, said matching fastening material appearing as 15 in FIG. 3. Also in FIG. 2 the centrally located thumbhole 7 can be seen.

The weighted pouch 4 is positioned just below the thumbhole 7 so that when the invention is wrapped around the hand, the weighted pouch 4 would fasten only to the backhand side 2. At the opposite end 13 of the device may be a strap 10 which, as mentioned before, has matching fastening material 15 on the other side for adjustably attaching to the fastening material 14. In this manner the device can be made to fit any size hand of a guitar player or other musician. The material in the weighted pouch 4 is kept in place by a border 19, which may be sewn through both layers of the invention.

Figure 3:
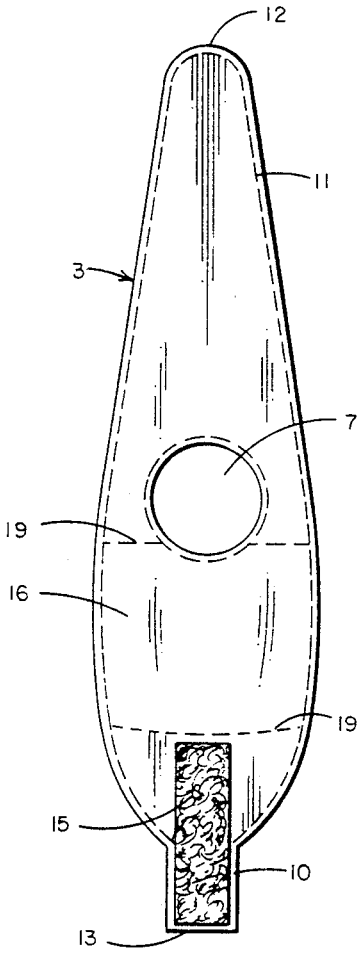
FIG. 3 is a direct view of the inner side of the invention in the open position.

FIG. 3 shows the inner side 3 of the invention and this side contains the same features as the other side 2 with the exception that on the bottom end 13 of the invention is the strap 10 which has the fastening material 15 attached thereto.

Figure 4:
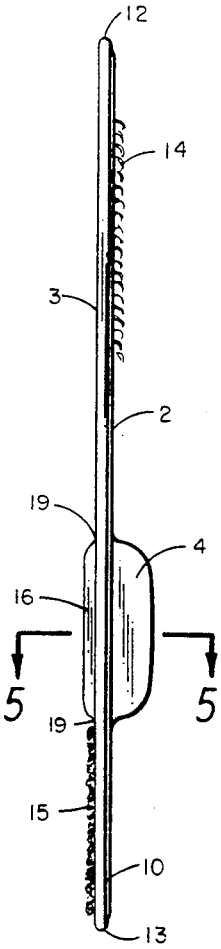
FIG. 4 is a side view of the invention in the open position.

The side view of the invention in FIG. 4 more clearly shows the weighted pouch 4 on the backhand side of the invention. All other features of the invention shown in FIG. 4 have been previously described in relation to the other drawings. This drawing does show both areas of fastening material, at the top end 12 shown as 14 may be hook and loop material such as Velcro which securely fastens the matching material 15 on the strap 10 with the bottom end 13 of the invention.

Figure 5:
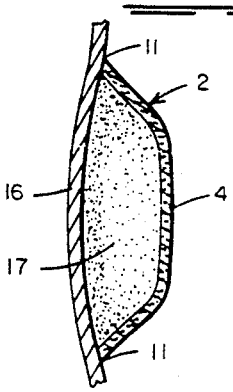
FIG. 5 is a cross-sectional view of the invention along lines 5—5 of FIG. 4.

The final drawing in FIG. 5 shows a cross-section of the weighted pouch 4. The weighted pouch 4 is shown containing the weighted filling 17 which could be almost any granular material, but preferably graphite, which is very dense and thus gives a greater weight for the volume of the pouch 4.

The materials to make the device may consist of a soft material, such as cloth, for the inner side 3 so that it is comfortable to the musician's hand. The outer side 2 may consist of the same soft cloth, but preferably a more durable material, such as vinyl or leather, would be used.

As described in detail above, it should be apparent that there has been provided a new, useful and nonobvious device for increasing the strength and endurance of the muscles of a musician's hand, wrist and lower arm particularly pertinent to the playing of guitars and other musical instruments, especially string instruments. The major advantageous feature of the device is that it enables the musician to wear it while playing a musical instrument, thus improving his or her ability to play and to strengthen the endurance of his or her muscles at the same time. Moreover, the device is structured so that it does not interfere with playing and fits securely and comfortably around the user's hand.

While one specific embodiment of the invention has been described in detail hereinabove, it should be understood that such is only illustrative of one embodiment and that various modifications may be made from the specific details described hereinabove without departing from the spirit and scope of the invention as set forth in the appended claims.

Having described in detail my invention, I claim the following:

1. An exercise handweight device for attachment around either hand comprising:

an elongated garment shaped to wrap around either the right or left hand having two layers of material, one layer on the inner side of the other layer on the outer side of said garment, said garment being thinner in width at each end where the garment has fastening means for securing it to either hand of a user than in the middle of the garment;

a hole, centrally located along the length and width of the device, to allow insertion of the thumb though said garment such that the hole completely encloses the thumb and the device can be worn on either hand in a same configuration;

a weighted pouch in the middle of the garment on only the outer side of the garment which rests against a backhand side of the user's hand when the device is worn; and means for fastening at each end of the garment in order that said garment can be secured around the hand such that the thinner end covers only the palm side and the middle of the garment covers the back side of the user's hand.

2. The exercise handweight device of claim 1 wherein the weighted pouch comprises a granular material sewn between the outer and inner layer of material, at a location such that the weighted pouch rests against the backhand side of the user's hand when the device is worn.

3. The exercise handweight device of claim 2 wherein the granular material is graphite.

4. The exercise handweight device of claim 1 wherein the fastening means comprises hook and loop fastening material at one end of the garment and matching hook and loop fastening material on the other end of the garment.

5. The exercise handweight device of claim 1 wherein the fastening means comprises a strap on one end of the device and a buckle at the other end of the device for securing the first strap.

6. The exercise handweight device of claim 1 wherein the garment is wider on the end which contains the weighted pouch than on the opposite end that does not contain the pouch.

* * * * *